US007581424B2

(12) United States Patent
Frauchiger

(10) Patent No.: US 7,581,424 B2
(45) Date of Patent: Sep. 1, 2009

(54) METHOD FOR THE REINFORCEMENT OF A WALL REGION OF A THREE-DIMENSIONAL ATTACHMENT

(75) Inventor: Paul Frauchiger, Cincinnati, OH (US)

(73) Assignee: Feintool Intellectual Property AG, Lyss (CH)

( * ) Notice: Subject to any disclaimer, the term of this patent is extended or adjusted under 35 U.S.C. 154(b) by 0 days.

(21) Appl. No.: 11/590,401

(22) Filed: Oct. 31, 2006

(65) Prior Publication Data

US 2008/0072650 A1 Mar. 27, 2008

(30) Foreign Application Priority Data

Sep. 13, 2006 (EP) ..... 06090167

(51) Int. Cl.
*B21D 22/00* (2006.01)

(52) U.S. Cl. ..... 72/356; 72/377

(58) Field of Classification Search ..... 72/356, 72/352, 353.2, 354.2, 354.6, 377, 267, 355.6, 72/348

See application file for complete search history.

(56) References Cited

U.S. PATENT DOCUMENTS

| | | | |
|---|---|---|---|
| 4,275,924 | A | 6/1981 | Lehmann et al. |
| 4,573,739 | A | 3/1986 | Schoettker |
| 5,531,504 | A | 7/1996 | Schmale et al. |
| 5,611,599 | A | 3/1997 | Baloche et al. |

FOREIGN PATENT DOCUMENTS

| | | |
|---|---|---|
| DE | 2834492 | 2/1980 |
| DE | 3227222 | 5/1984 |
| DE | 3244399 | 6/1984 |
| DE | 4140720 | 6/1993 |
| EP | 0694434 | 1/1996 |
| EP | 0 937 523 | 8/1999 |
| WO | WO 2005/077565 A1 * | 8/2005 |

* cited by examiner

*Primary Examiner*—Dana Ross
*Assistant Examiner*—Debra M Sullivan
(74) *Attorney, Agent, or Firm*—Jordan and Hamburg LLP

(57) ABSTRACT

A method for the reinforcement of a wall region of a three-dimensional attachment for high torque loads, wherein, a plate with a substantially evenly curved outer contour is cut out of a flat strip and the plate is formed and fine blanked into a pot-shaped body with projections and/or impressions and/or indentations and/or recesses and/or sinks and/or holes and/or pivots by a forming and fine blanking tool including die, counter-die, die plate, V-shaped projection and pressure plate, whereby a circular edge for a toothing is formed at the body. Hinge attachments with a much higher safety with regard to fracture of the wall region between the edge with an inner toothing and the pot-shaped body of the hinge attachment are producible in a cost-effective way. The thickness of the wall region between the edge and the pot-shaped body of the attachment by a purposeful material shifting with at least a two-staged cold-extrusion process in respectively opposite flow directions angular to the die movement is reinforced in such manner that the purposeful material shifting in the wall region approximately equalizes the runoff of material caused by the forming.

2 Claims, 5 Drawing Sheets

METHOD FOR THE REINFORCEMENT OF A WALL REGION OF A THREE-DIMENSIONAL ATTACHMENT

BACKGROUND OF THE INVENTION

The invention relates to a method for the reinforcement of a wall region of a three-dimensional attachment, especially car seat components for high torque loads, wherein a plate with a substantially evenly curved outer contour is cut out of a flat strip and, subsequently, the plate is formed and fine blanked into a pot-shaped body with projections and/or impressions and/or indentations and/or recesses and/or sinks and/or holes and/or pivots by means of a forming and fine blanking tool including die, counter-die, die plate, V-shaped projection and pressure plate, whereby a circular edge for a toothing is formed at the body.

Conventional seat adjustment components, for example, fixed and swiveling hinge parts of hinge attachments, are produced by forming, fine blanking or stamping with the necessary high dimensional accuracy for their final use (see, for example, EP 0 694 434 B1, DE 32 44 399 C2, DE 28 34 492 C2, DE 32 27 222 C1).

These known hinge parts substantially consist of a pot-shaped body with projections and/or impressions and/or indentations and/or recesses and/or sinks and/or holes and/or pivots. The body is provided with an evenly curved outer contour having a circular edge, into which is formed a toothing which is radially directed to the inner side thereof. This toothing has to functionally transmit very high rotational moments, so that the wall region between edge and body, i.e., the connection to the pot-shaped body, receives substantial loads, which often lead to fractures. This impairs the safety and reliability of the seat adjustment components.

In view of the aforementioned state of the art, it is an object of the invention to provide a method by which hinge attachments with a much higher safety with regard to fracture of the wall region between the edge with an inner toothing and the pot-shaped body of the hinge attachment can be produced in a cost-effective way.

SUMMARY OF THE INVENTION

This object is solved by a method of the kind discussed above, wherein a process according to the invention includes cutting a plate out of a flat strip with a substantially evenly curved outer contour and forming and fine blanking the plate into a pot-shaped body with a desired structural configuration including a surface formation, whereby at the body is formed a curved edge for a toothing. The thus formed pot-shaped body includes a wall region between the curved edge and a base thereof. By performing at least a two-staged cold-extrusion process in respectively opposite flow directions angular to a respective die movement prior to said step of forming to cause a purposeful material shifting in an area of the plate corresponding to the wall region to a degree that approximately equalizes runoff of the material caused by the subsequent forming, the wall region of the attachment is reinforced when formed.

In accordance with the hinge attachment produced according to the method of the invention, because the thickness of the wall region between the edge and the pot-shaped body of the attachment reaches a wall thickness approximately equal to the original wall thickness by a purposeful material shifting with at least a two-staged cold-extrusion process in respectively opposite flow directions angular to the die movement despite forming, a hinge attachment is formed without problems and withstands extremely high fracture loads.

The invention provides particular further advantage, in that high rotational moments can be transmitted without problems, so that hinge attachments are provided which are also suitable for special or defined load values, for example, for fixing a safety belt to the back of the seat of a car.

The shifting of material into the wall region of the connection provides additional advantage, in that the cutting becomes possible over the whole thickness of the material, so that the application of fine blanking becomes economically efficient, also, with complex and complicated three-dimensional multi-functional parts.

Further advantages and details will be understood from the following description with reference to the enclosed drawings.

DETAILED DESCRIPTION OF THE INVENTION

In accordance with the method of the invention, three-dimensional multifunctional hinge attachments 1 for car seat components can be produced, which are fracture-proof at high loads, for example, up to 6000 N.

Figure 1:
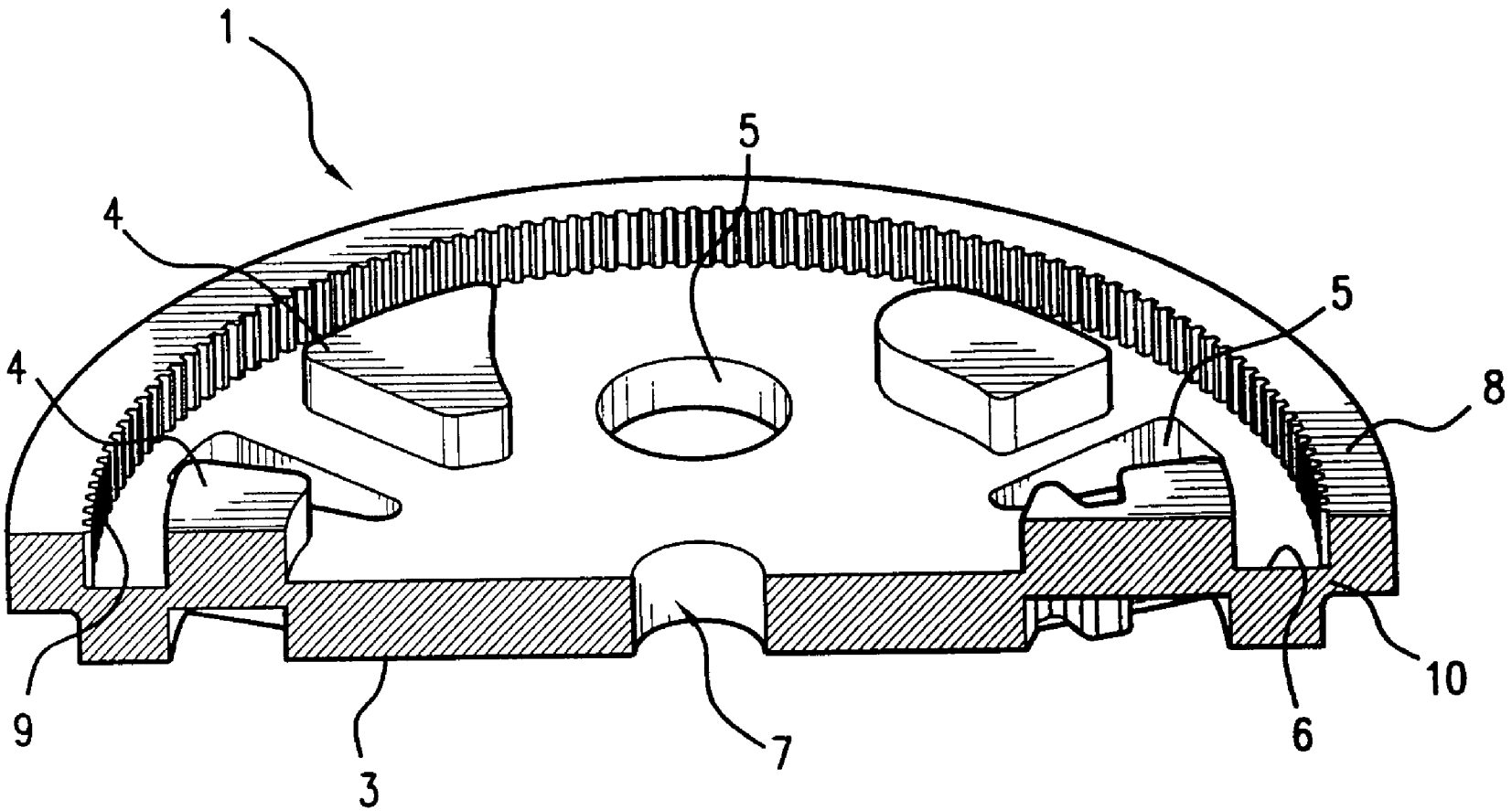
FIG. 1 is a sectional view through a hinge attachment according to the invention.

FIG. 1 shows a section through a circular hinge attachment 1, which was produced out of a plate 2 of a flat steel strip with a thickness of for example 3 to 8 mm. It is noted, however, that hinge attachment 1 is not limited to such geometrical shape.

The plate 2 undergoes a combined forming and fine blanking process in the course of which the three-dimensional hinge attachment 1 is created.

The hinge attachment 1 comprises a pot-shaped body 3, in which projections 4, impressions 5, a depression 6 and a hole 7 are formed by forming operations. The body 3 has a circular edge 8, which is provided with a toothing 9 radially directed to the inner side. Depression 6 and edge 8 are connected by a wall region 10.

Figure 2:
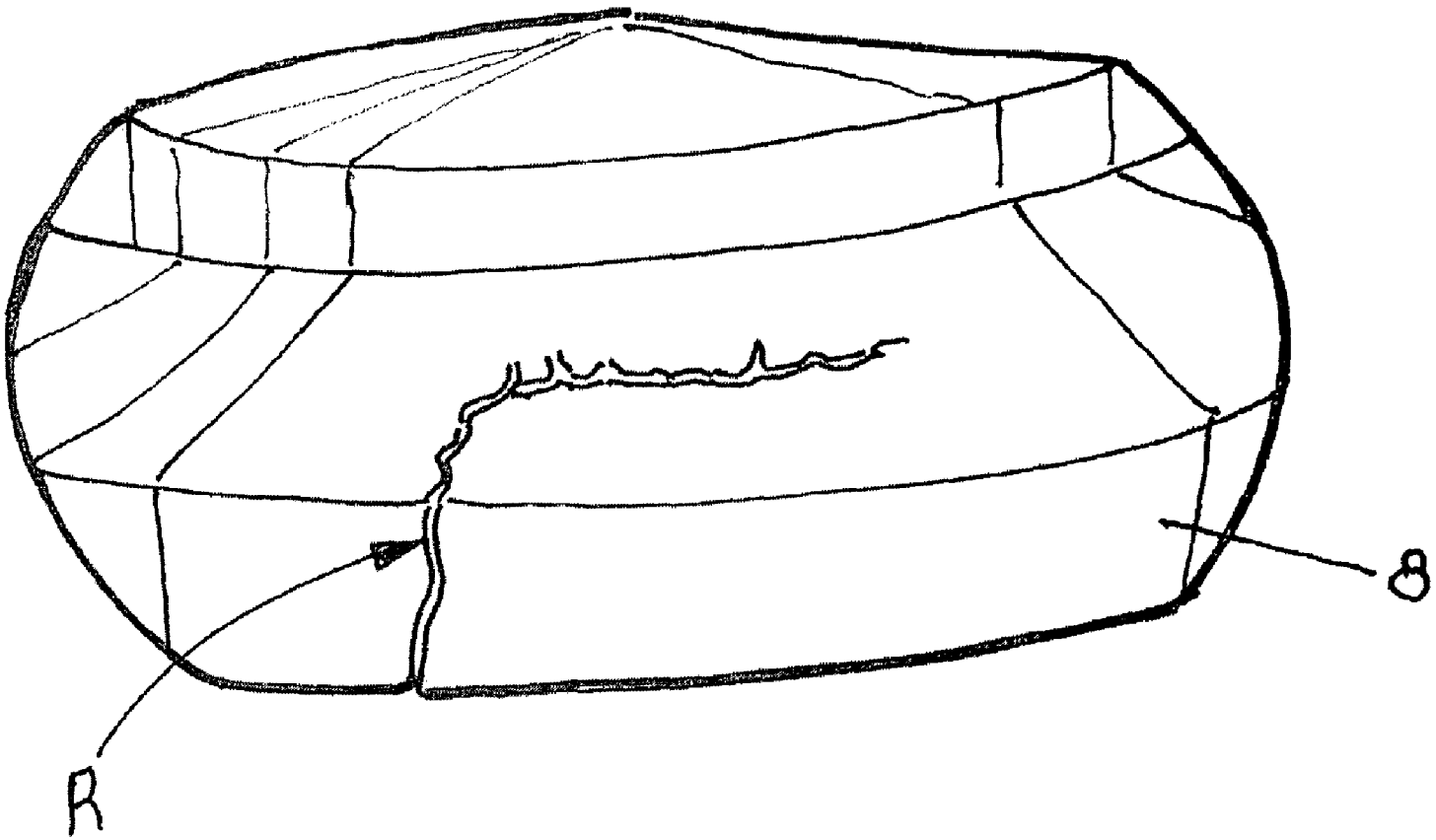
FIG. 2 is an enlarged view of a crack in the connection region between an edge and the pot-shaped body of the hinge attachment.
Figure 3A:
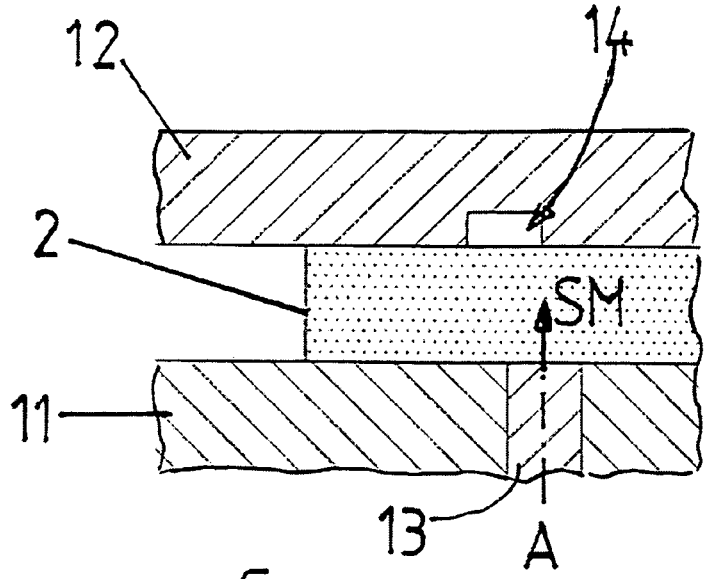
FIGS. 3*a* to 3*d* each is a schematic diagram of the sequences of the method according to the invention.
Figure 3B:
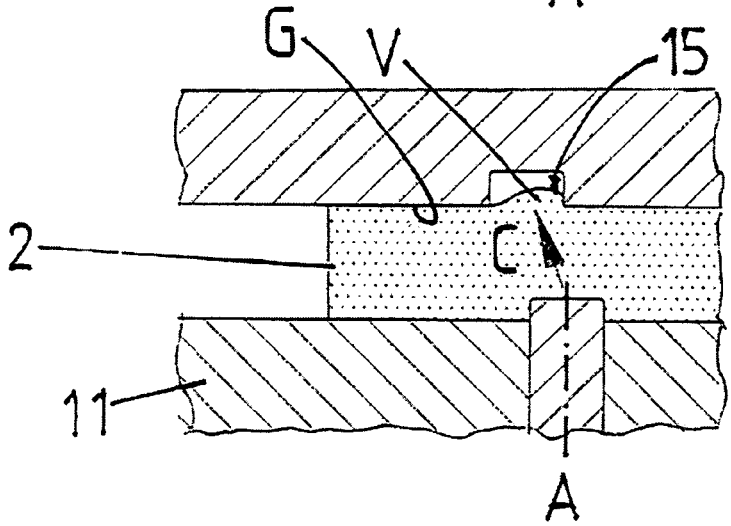
Figure 3C:
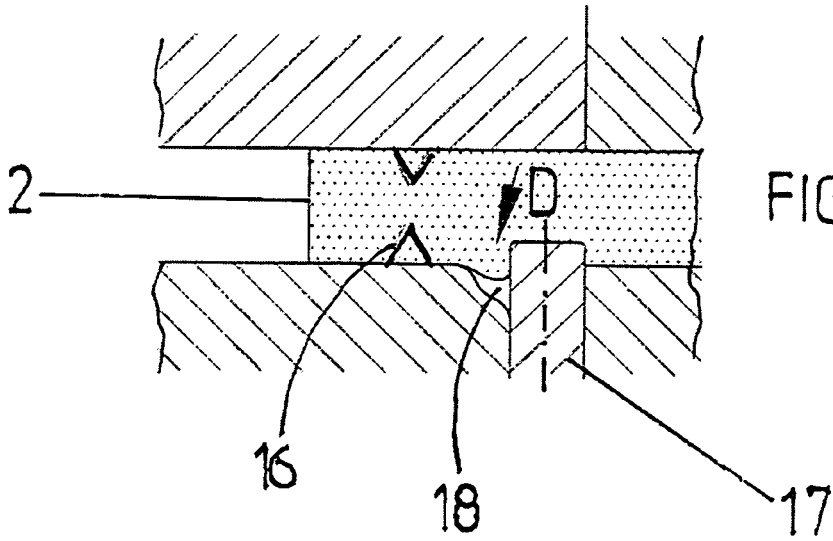
Figure 3D:
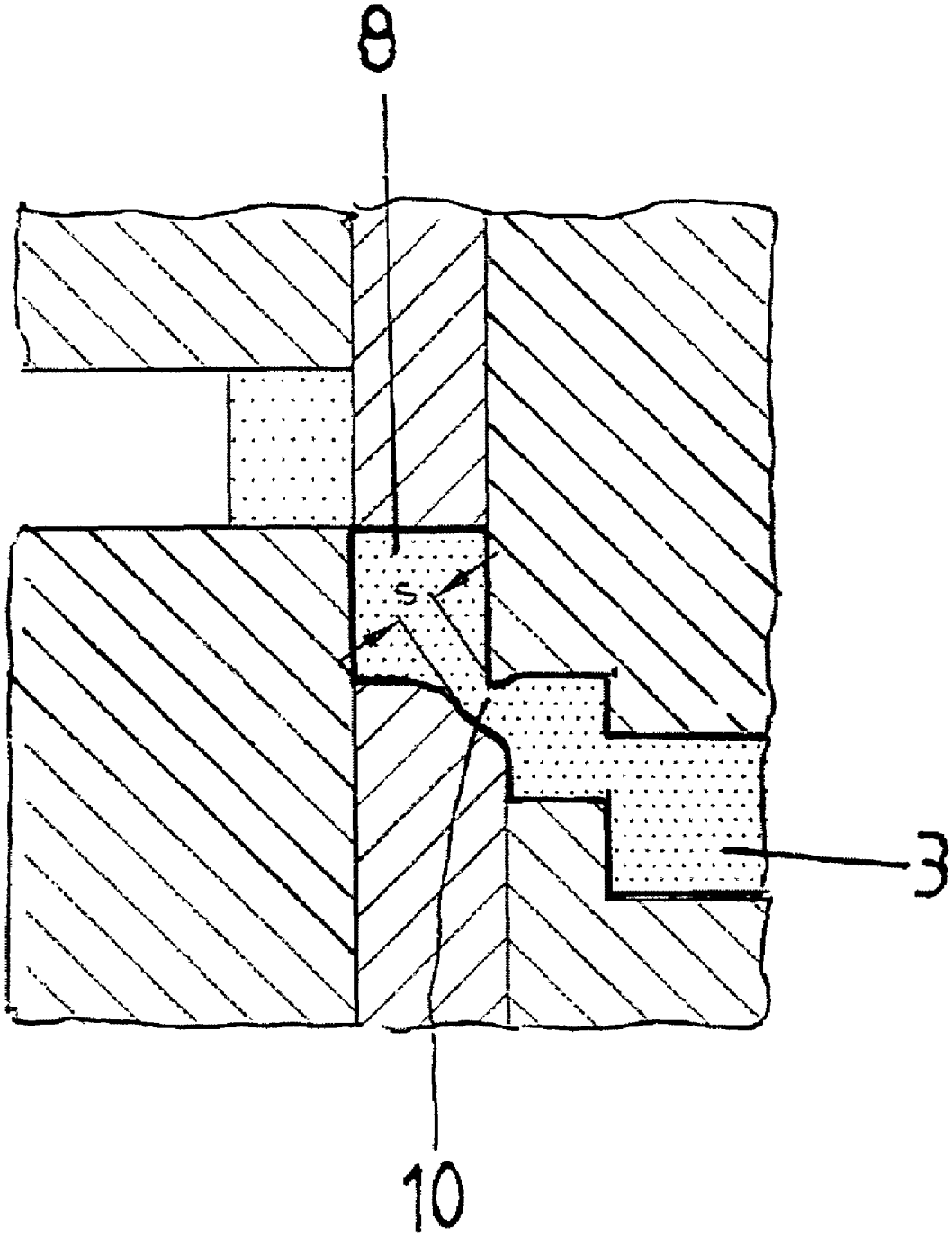

The wall region 10 between the edge 8 and the indentation 6 of the pot-shaped body 3 is weakened during forming, i.e., a flow of material takes place from the wall region 10 in the direction of the indentation 6. This, under load, leads to the crack R in the wall region 10, shown in FIG. 2.

FIGS. 3*a* to 3*d* schematically show the sequence of operations of the method according to the invention. According to FIG. 3*a*, the plate 2 is firmly fixed between a pressure pad 11 and a die plate 12. A die 13 controlled by the pressure pad 11 executes an upward movement in the direction SM of the die plate 12. In the die plate 12 is provided a space 14, which lies slightly offset in relation to the die axis A.

In the first step of the method according to this invention, the die 13 moves upward in the direction of die plate 12, whereby a respective material volume V flows into the space 14 sideward of die 13 (see direction of arrow C). This material volume V fills the space 14 and thus at the side G of plate 2 opposite to die 13 occurs a material accumulation 15.

The thus formed plate 2, in the second step of the method according to the invention, additionally is fixed by a V-shaped projection 16 and the material accumulation 15 at the opposite side G by a counter-die 17 is shifted in a direction contrary to the direction of arrow C (see direction of arrow D), so that material flows into a space 18 sideward of die 17 and strengthens the wall region 10 between edge 8 and indentation 5 in the pot-shaped body 3 to the wall thickness s (see FIGS. 3*c* and 3*d*), which, in this example, approximately corresponds with the material volume lost by flow during forming.

Figure 4:
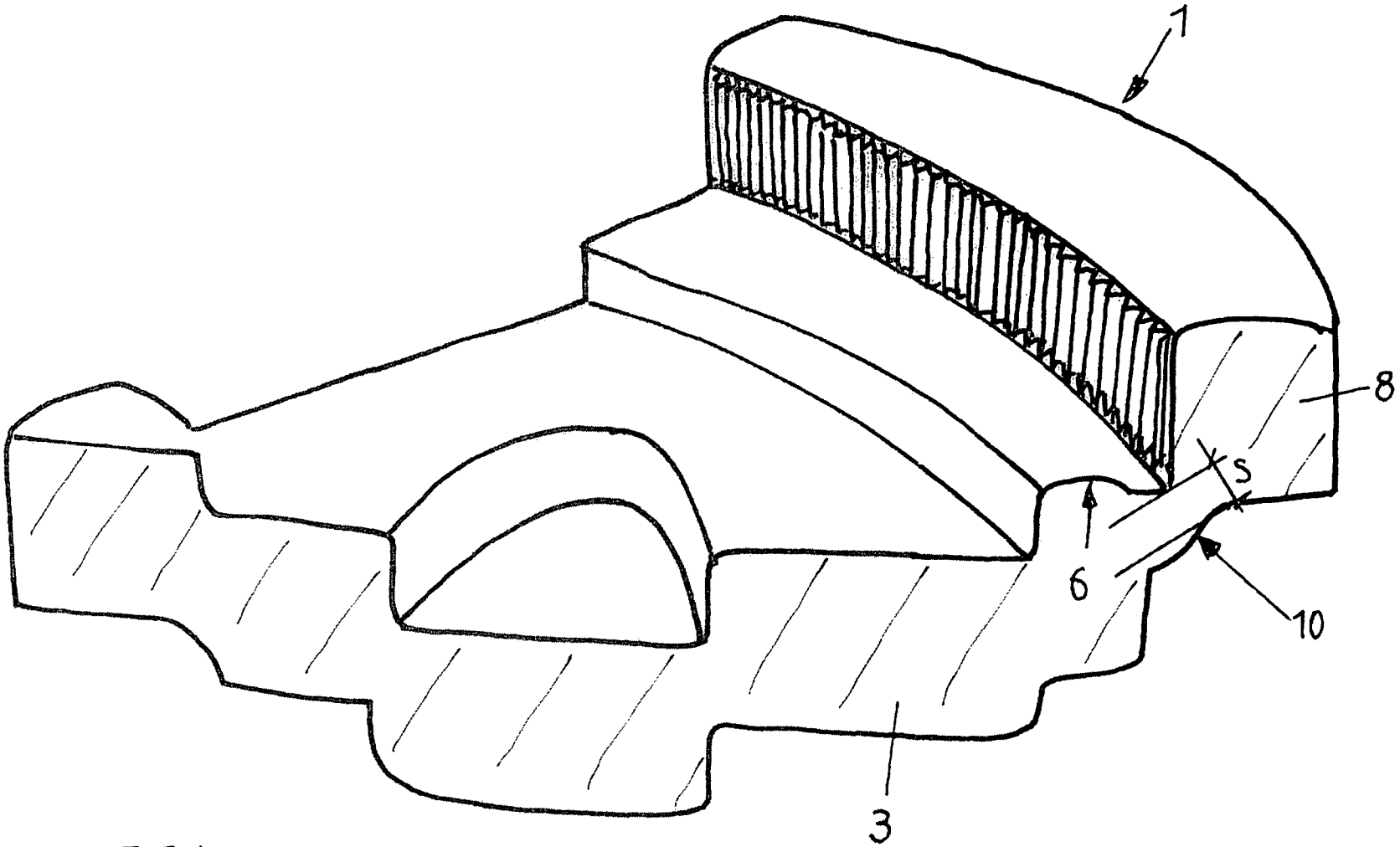
FIG. 4 is a perspective view of a section through a three-dimensional hinge attachment produced according to the method of the invention.

By dimensioning the spaces 14 and 18 the material volume V to be shifted can be determined, whereby it is possible to strengthen the wall thickness s of the wall region 10 to a value that is safe for a defined fracture load. Such a fracture-proof hinge part 1 is shown in FIG. 4. The dimensioning of spaces 14 and 18 results from the flow properties of the material of plate 2, the hardness and stability under load of the dies 13 and 17, the lubricant, the design of the tool as well as the necessary fracture load in the case of application.

Thus it becomes possible to reach fracture safeties much higher than the fracture load of these wall regions.

| List of drawing references | |
|---|---|
| hinge attachment | 1 |
| plate | 2 |
| body of 1 | 3 |
| projections | 4 |
| impressions | 5 |
| depression | 6 |
| hole | 7 |
| edge | 8 |
| toothing | 9 |
| wall region between 8 and 6 | 10 |
| pressure pad | 11 |
| die plate | 12 |
| die | 13 |
| space in 12 | 14 |
| material accumulation | 15 |
| V-shaped projection | 16 |
| counter-die | 17 |
| space in pressure pad | 18 |
| die axis | A |
| direction of arrow in flow direction | C |
| direction of arrow contrary to flow direction | D |
| opposite side of 2 | G |
| crack in 10 | R |
| direction of die 13 | SM |

-continued

| List of drawing references | |
|---|---|
| wall thickness of 10 | s |
| material volume | V |

The invention claimed is:

1. A method for reinforcing a wall region of a three-dimensional attachment for high torque loads, comprising:

cutting a plate out of a flat strip with a substantially evenly curved outer contour; and forming and fine blanking the plate into a pot-shaped body with a desired structural configuration including a surface formation, whereby at the body is formed a curved edge with a toothing, said pot-shaped body including a wall region between the curved edge and a base of the pot-shaped body of the attachment, and further performing at least a two-staged cold-extrusion process in respectively opposite flow directions angular to a respective die movement to cause a purposeful material shifting in an area of the plate corresponding to the wall region to a degree that approximately equalizes runoff of the material caused by the forming to reinforce the wall region of the attachment when formed, in a first step of said at least a two-staged cold-extrusion process, the material in a region of the plate is caused to flow by a moving die in a direction corresponding to a die movement direction in a manner such that a material volume is accumulated in a space in a pressure plate contacting an outer side of the plate opposite to said die and lying in a direction angular to the die movement direction, and in a second step of said at least a two-staged cold-extrusion process, the accumulated material volume created by the cold-extrusion is shifted in another direction opposite to said direction in the first step into another space in a pressure pad in a manner such that the wall region develops a desired thickness when formed which is tailored to a required load.

2. A method according to claim 1, wherein the reinforcement of the wall thickness in the wall region is adjusted by selecting dimensions and forms of the spaces in the pressure plate and in the pressure pad.

* * * * *